US005945819A

United States Patent [19]

Ursino et al.

[11] Patent Number: 5,945,819

[45] Date of Patent: Aug. 31, 1999

[54] VOLTAGE REGULATOR WITH FAST RESPONSE

[75] Inventors: Riccardo Ursino, Catania; Roberto Gariboldi, Lacchiarella, both of Italy

[73] Assignees: SGS-Thomson Microelectronics S.r.l., Agrate Brianza; Consorzio per la Ricerca sulla Microelettronica nel Mezzogiorno, Catania, both of Italy

[21] Appl. No.: 08/865,393

[22] Filed: May 29, 1997

[30] Foreign Application Priority Data

May 31, 1996 [EP] European Pat. Off. ..... 96830312

[51] Int. Cl.[6] ..... G05F 1/40

[52] U.S. Cl. ..... 323/282; 327/538

[58] Field of Search ..... 323/282, 285; 363/21; 322/28; 327/538

[56] References Cited

FOREIGN PATENT DOCUMENTS

A-2 102 166 1/1983 United Kingdom ..... G05F 1/10

OTHER PUBLICATIONS

Patent Abstracts of Japan, vol. 8, No. 157 (P–288) [1594], Jul. 20, 1984 & JP–A–59 055517 (abstract) (Mitsubishi).

*Primary Examiner*—Stuart N. Hecker

*Attorney, Agent, or Firm*—Wolf, Greenfield & Sacks, P.C.

[57] ABSTRACT

The invention relates to a voltage regulator connected between first and second voltage references and having an output terminal for delivering a regulated output voltage. The voltage regulator includes at least one voltage divider, connected between the output terminal and the second voltage reference, and a serial output element connected between the output terminal and the first voltage reference. The voltage divider is connected to the serial output element by a first conduction path which includes at least one error amplifier whose output is connected to at least one driver for turning off the serial output element. The voltage regulator includes, between the voltage divider and the serial output element, at least a second conduction path for turning off the serial output element according to a value of the regulated output voltage in advance of the action of the first conduction path.

25 Claims, 6 Drawing Sheets

VOLTAGE REGULATOR WITH FAST RESPONSE

BACKGROUND OF THE INVENTION

1. Field of the Invention

This invention relates to a voltage regulator with a fast response and low power consumption.

2. Discussion of the Related Art

As it is well known, voltage regulators of the low-drop type are in growing demand for modern electronic devices. These regulators have an internal voltage drop limited to a few hundred millivolts, which enhances their effectiveness for a number of applications.

As is also known, a critical parameter in the design of a voltage regulator is the current consumption of the regulator. This parameter is of strategic importance to applications involving a limited load current, and especially wherever the regulator is expected to remain in a stand-by state for most of the time and the power supply is provided by a set of batteries.

A known voltage regulator 1 is shown schematically in FIG. 1 as including a voltage divider 2 connected between an output terminal OUT and a voltage reference, such as a signal ground GND, in parallel with a regulation capacitance Co'.

In the example of FIG. 1, the voltage divider 2 comprises first and second resistive elements R'1, R'2, and is connected at a common node between the resistive elements R'1, R'2 to a first input terminal 3 of an error amplifier EA' having a second input terminal 4 to receive a reference voltage Vref and an output terminal 5 connected to an input terminal 6 of a driver DR'. The first and second input terminals 3, 4 of the error amplifier EA' are of the inverting and non-inverting type, respectively.

The driver DR' is connected between a program voltage reference VS/Vcp and the ground GND, and has an output terminal 7 connected to a terminal 8 of a serial output element 9 which is in turn connected between a supply voltage reference VS and the output terminal OUT of the regulator 1.

Depending on applicational requirements, the supply voltage reference VS may be used as the program voltage reference VS/Vcp.

In order to lower the power consumption of voltage regulator 1, a serial output element 9 of the MOS type, i.e. a MOS transistor of the P-channel or the N-channel type, is used which, being voltage driven, makes the internal current consumption of the regulator 1 independent of an output current Io.

Thus, the internal consumption of the regulator 1 of FIG. 1 is limited to a few microamperes, and results from the following contributions:

the consumption across the voltage divider 2;

the consumption of the error amplifier EA'; and the consumption of the driver DR'.

In particular, the current consumption of the driver DR' is of fundamental importance to the performance of the regulator 1 in that it determines a delay in the feedback loop, and therefore, the response of regulator 1 to a transient.

As shown in FIGS. 2*a* and 2*b*, the driver DR', comprising a MOS transistor M1 and a drive current generator G1 connected in series with each other between the program voltage reference VS/Vcp and the ground GND, is basically an active load amplifier stage; this active load also includes a gate capacitance Cg of the serial element 9.

The driver DR' is responsive to a load change, that is, a change in the current Io flowing through the serial element 9, so as to cause a change in a gate voltage Vg applied to the serial element 9.

While being in some ways advantageous, this first solution still has some drawbacks.

In fact, a change ΔVg in the gate voltage Vg across the gate capacitance Cg of the serial element 9 (whether the gate voltage Vg should increase, as shown in FIG. 2*a*, or decrease, as shown in FIG. 2*b*) occurs with a time delay T as follows:

$$T = \frac{\Delta Vg * Cg}{I} \tag{1}$$

I being a constant current from the drive current generator G1.

During this time delay T, the serial element 9 delivers a different current from that required by the load, which causes an output voltage Vout' to change. This results in a reduced value of the current I from the drive current generator G1, which may cause a too large time delay T, and consequently, a response to the transient from the regulator 1 having very large changes (perhaps of several volts) in the output voltage Vout'.

Thus, the application of such a known regulator to logic circuits or microprocessors, which are highly sensitive to changes in the output voltage Vout', generates serious problems.

A second solution instead provides for the driver DR' to be in the AB class, thereby limiting the changes in the output voltage Vout'.

Although achieving its objective, not even this solution is devoid of drawbacks.

First, the internal consumption of the regulator 1 is increased. Secondly, for a serial element 9 comprising an N-channel MOS transistor, the added consumption of the AB class driver DR' should be supplied by a charge pump within the regulator 1 which would have to be proportioned in order to supply a larger current, and whose provision adds a low output impedance stage which alters the frequency performance of the regulator.

SUMMARY OF THE INVENTION

This invention provides a fast response voltage regulator having construction and performance features so as to limit the internal current consumption of the regulator without altering its frequency performance, thereby overcoming the drawbacks with which the related art regulators are beset.

The present invention connects a switching circuit in parallel with a drive current generator for a driver of a serial output element, such that the switching circuit can control a gate capacitance of the serial output element with a fast response speed.

Specifically, the invention concerns a voltage regulator connected between first and second voltage references and having an output terminal for delivering a regulated output voltage. The voltage regulator includes at least one voltage divider connected between the output terminal and the second voltage reference, and a serial output element connected between the output terminal and the first voltage reference. The voltage divider is connected to the serial output element by a first conduction path which includes at least one error amplifier a first output of which is connected to at least one driver for turning off the serial output element.

The invention also concerns a method of turning off a serial output element as a regulated output voltage from a voltage regulator changes, the voltage regulator including a first conduction path connected between a divider of the regulated output voltage and the serial output element to turn off the serial output element upon a change occurring in the regulated output voltage.

The invention relates, particularly but not exclusively, to a voltage regulator of a low-drop type having a limited internal voltage drop, and the description that follows will make reference to such an application for convenience of explanation.

The features and advantages of a regulator according to the present invention can be appreciated from the following detailed description of an embodiment thereof, given by way of example and not one of limitation with reference to the accompanying drawings.

DETAILED DESCRIPTION

Figure 1:
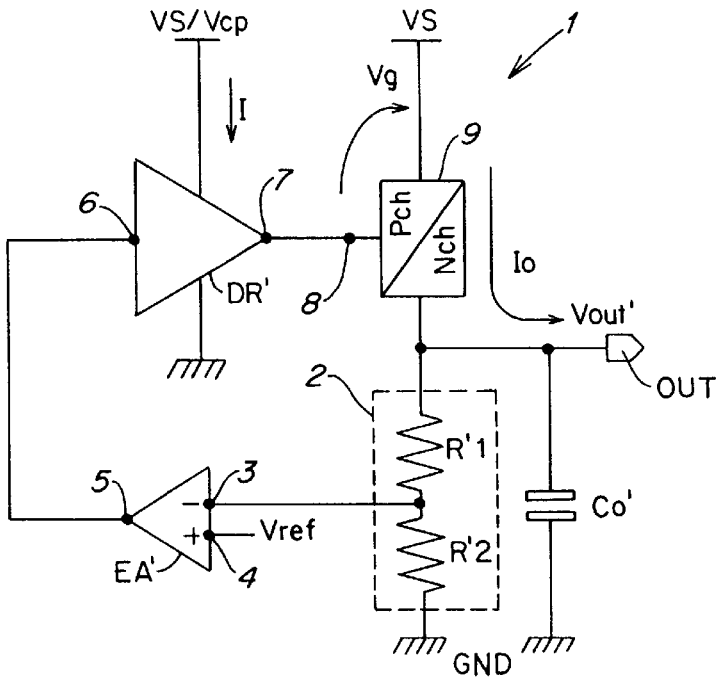
Fig. 1 (PRIOR ART)
FIG. 1 shows diagrammatically a known voltage regulator.
Figure 2A:
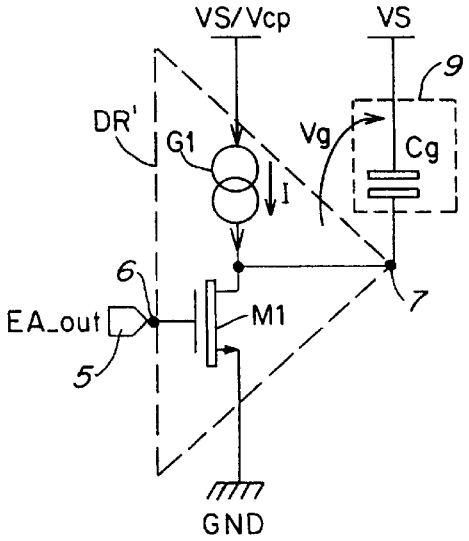
Fig. 2a (PRIOR ART)
FIGS. 2*a* and 2*b* illustrate respective modified embodiments of a detail of the regulator shown in FIG. 1.
Figure 2B:
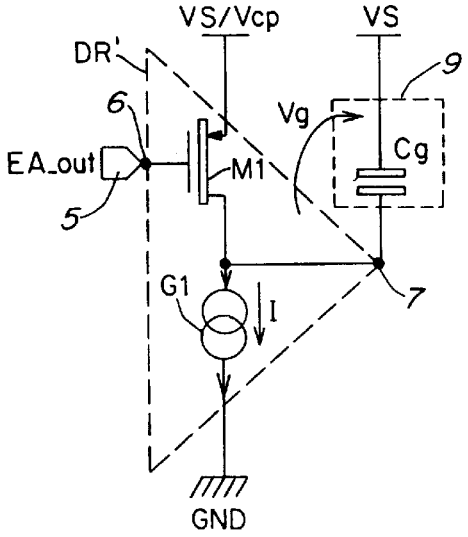
Fig. 2b (PRIOR ART)
Figure 3A:
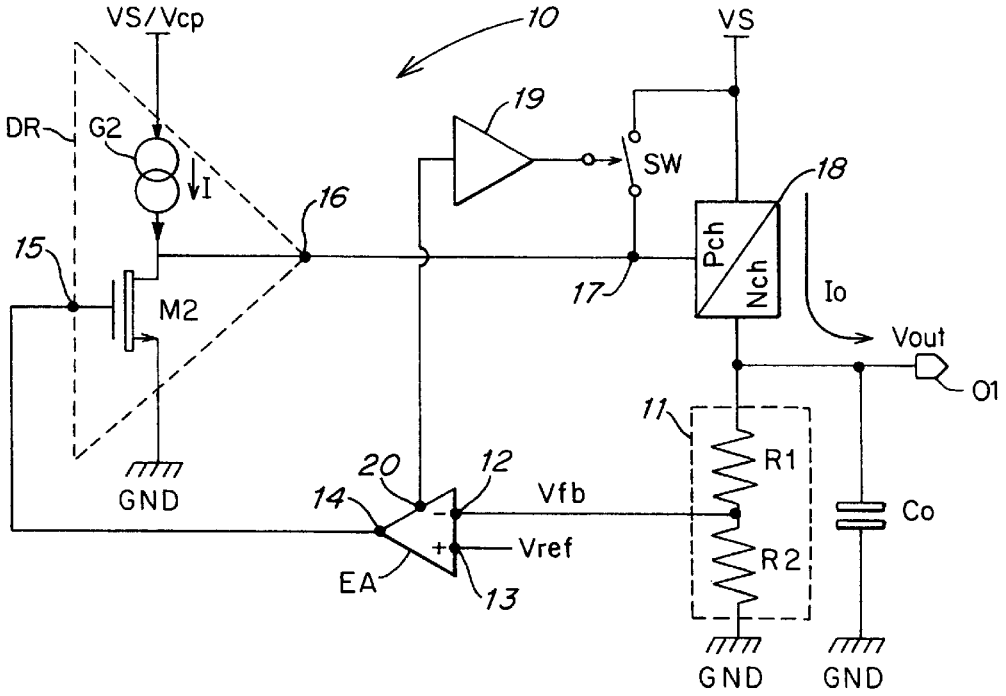
FIG. 3*a* shows diagrammatically an embodiment of a regulator according to the present invention.
Figure 3B:
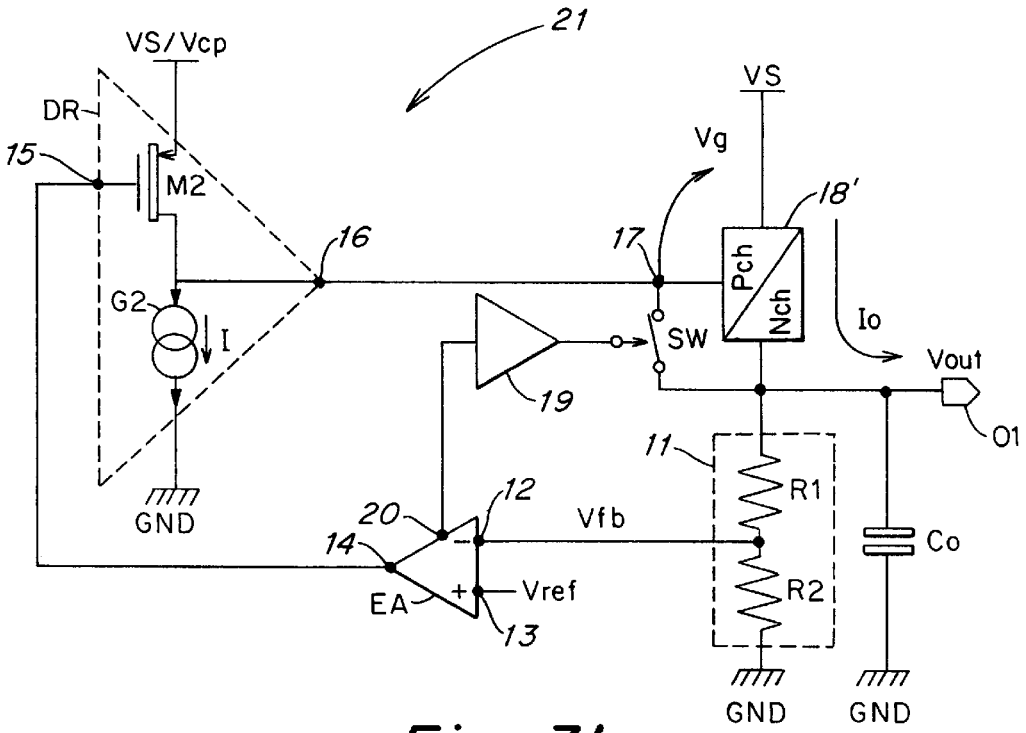
FIG. 3*b* shows diagrammatically a modified embodiment of a regulator according to the present invention.

With reference to FIGS. 3*a* and 3*b,* shown generally at 10 is a voltage regulator according to the present invention.

The voltage regulator 10 has an output terminal O1 where an output voltage Vout is present, and a voltage divider 11 which is connected between the output terminal O1 and a voltage reference, such as a signal ground GND. A regulation capacitor Co is in parallel with the voltage divider 11. The voltage divider 11 includes first and second resistive elements, R'1, R'2, and a common node between them is connected to a first input terminal 12 of an error amplifier EA. The error amplifier EA has a second input terminal 13 which receives a reference voltage Vref, and an output terminal 14 which is connected to an input terminal 15 of a driver DR. In particular, the first input terminal 12 and the second input terminal 13 of the error amplifier EA are of the inverting and non-inverting type, respectively.

The driver DR is connected between a program voltage reference VS/Vcp and the signal ground GND, and has an output terminal 16 connected to a terminal 17 of a serial output element 18. The serial output element 18 is connected between a supply voltage reference VS and the output terminal O1 of the regulator 10.

The driver DR includes a MOS transistor M2 and a drive current generator G2, connected in series with each other between the program voltage reference VS/Vcp and the ground GND. Depending on applicational requirements, the supply voltage reference VS could be used as the program voltage reference VS/Vcp.

The serial output element 18 is of the MOS type, that is, a MOS transistor of the P-channel or N-channel type.

The voltage divider 11 and the serial output element 18 are, therefore, connected together by a first conduction path which includes the error amplifier EA and the driver DR.

Advantageously, the regulator 10 of the present invention has a second conduction path interconnecting the voltage divider 11 and the serial output element 18. This second conduction path includes a switch SW driven by a switching stage 19 which is connected in turn to a second output terminal 20 of the error amplifier EA.

In the embodiment of FIG. 3*a,* the regulator 10 comprises a serial element 18 of the P-channel MOS type, and said switch SW is connected between the terminal 17 of the serial output element 18 and the supply voltage reference VS.

As shown in FIG. 3*b,* a modified embodiment of a regulator 21 according to the present invention includes a serial element 18' of the N-channel MOS type, wherein said switch SW is connected between the terminal 17 of the serial output element 18' and the output terminal O1 of the regulator 21.

Figure 4:
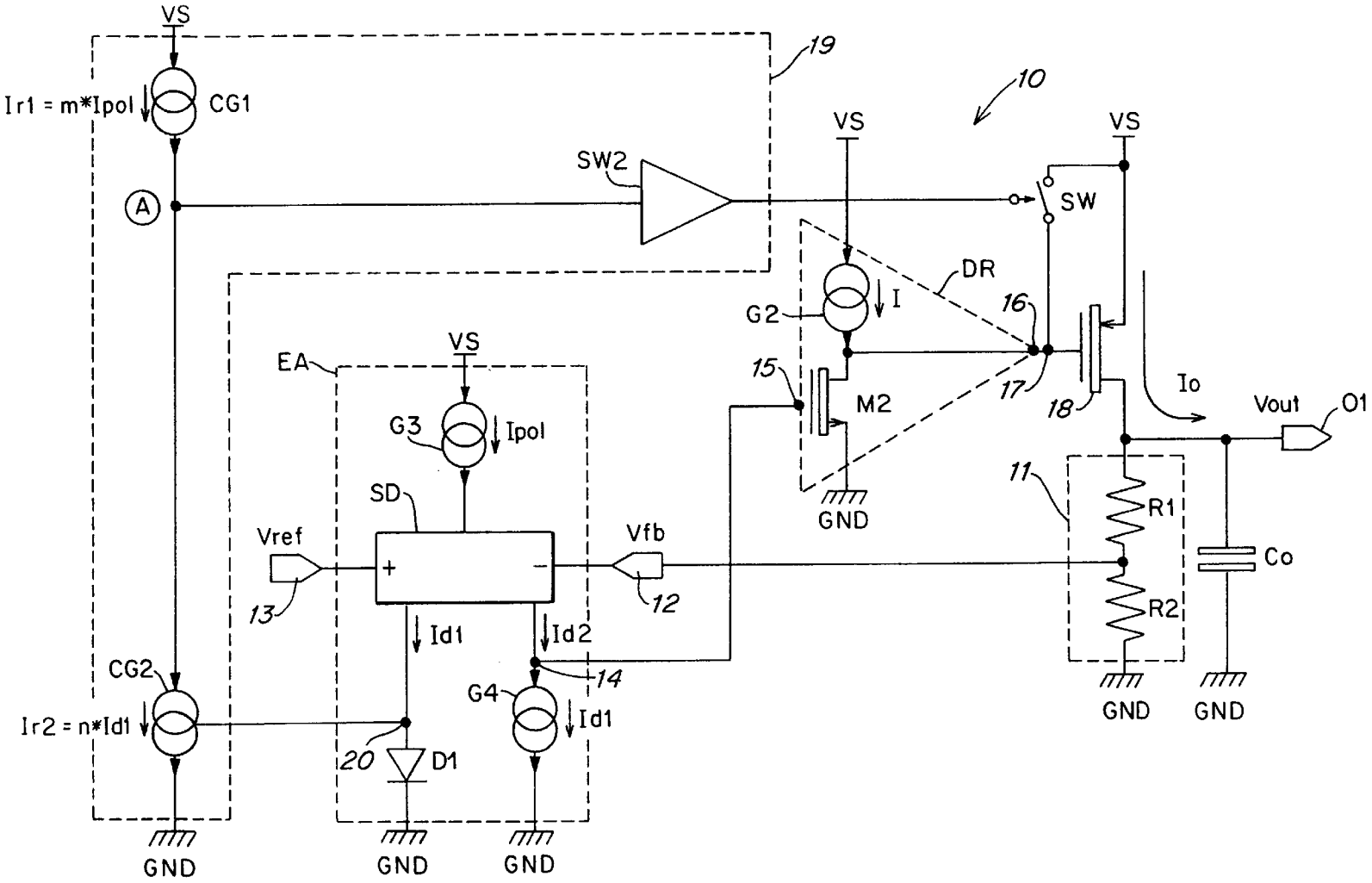
FIG. 4 shows in greater detail structure of the regulator in FIG. 3*a;*

Shown in greater detail in FIG. 4 is the voltage regulator 10 which includes a serial element 18 of the P-channel type, in accordance with a modified embodiment of this invention.

In particular, the error amplifier EA comprises a differential stage SD connected to a voltage reference, such as the supply voltage reference VS, through a generator G3 of a bias current Ipol.

The second output terminal 20 of the error amplifier EA, which delivers a first reference current Id1, is connected to ground GND through a diode D1, while the output terminal 14, delivering a second reference current Id2 and being connected to the input terminal 15 of the driver DR, is similarly connected to the ground GND, through a current controlled current, generator G4 of the first reference current Id1.

The switching stage 19 comprises first and second generators CG1, CG2 adapted to generate first and second regulation currents Ir1, Ir2, respectively. These generators CG1, CG2 are connected in series with each other between the supply voltage reference VS and the ground GND, and are interconnected at an internal circuit node A, which is connected to a switch Driver SW2.

In addition, the second regulation current generator CG2 is connected to the second output terminal 20 of the error amplifier EA.

Accordingly, the switch SW of the serial output element 18 will be controlled directly from the error amplifier EA, via the switching stage 19, and be forced to switch when the error amplifier EA is unbalanced. Thus, the switch SW can be closed in a very short time, and the switching stage 19 can have a very low current draw in the static condition.

In particular, for the regulator 10 to operate properly, the first generator CG1 will deliver to the internal circuit node A the first regulation current Ir1, which is m times as large as the bias current Ipol provided to the differential stage SD of the error amplifier EA. On the other hand, the second generator CG2 will draw the second regulation current Ir2 from the internal circuit node A, which current is n times as large as the first reference current Ir1 of the differential stage SD of the error amplifier EA.

In a regulated condition, i.e. in a condition of symmetry of the differential stage SD, the first reference current Ir1 is given by the following relationship:

$$Id1 = \frac{1}{2} * Ipol \tag{1}$$

Therefore, the second regulation current Ir2, derived from the node A by the second generator CG2, is given by the following relationship:

$$Ir2 = \frac{n}{2} * Ipol \tag{2}$$

Under this regulated condition, the switch SW is bound to be open, and the node A is bound to have a voltage value corresponding to a high logic value. This means that the first generator CG1 must be saturated, i.e., that the following relationship should hold:

$$m * Ipol > \frac{n}{2} * Ipol \Rightarrow m > \frac{n}{2} \tag{3}$$

Advantageously, according to the present invention, as the first generator CG1 is saturated, only the second regulation current Ir2, as supplied by the second generator CG2 alone and obeying relationship (2), will be flowing through the switching stage 19. In the regulated condition, this second reference current Ir2 is, therefore, the single item of additional consumption by the regulator 10.

As the output voltage Vout of the regulator 10 rises above a regulation value, the first reference current Ir1 of the differential stage SD of the error amplifier EA will tend to increase, thereby causing the current from the second generator CG2 to also increase.

The switching stage 19 will switch as the second regulation current Ir2 from the second generator CG2 exceeds the first regulation current Ir1 from the first generator CG1, i.e., when, $$n * Id1 \geq m * Ipol \Rightarrow Id1 \geq \frac{m}{n} * Ipol \tag{4}$$

Under this condition, the voltage at the internal circuit node A will fall sharply, and the switch SW2 will drive the switch SW to turn off the serial output element 18, thereby preventing it from delivering any more current Io to a load connected to the output terminal O1 and, consequently, from further increasing the output voltage Vout.

Figure 5:
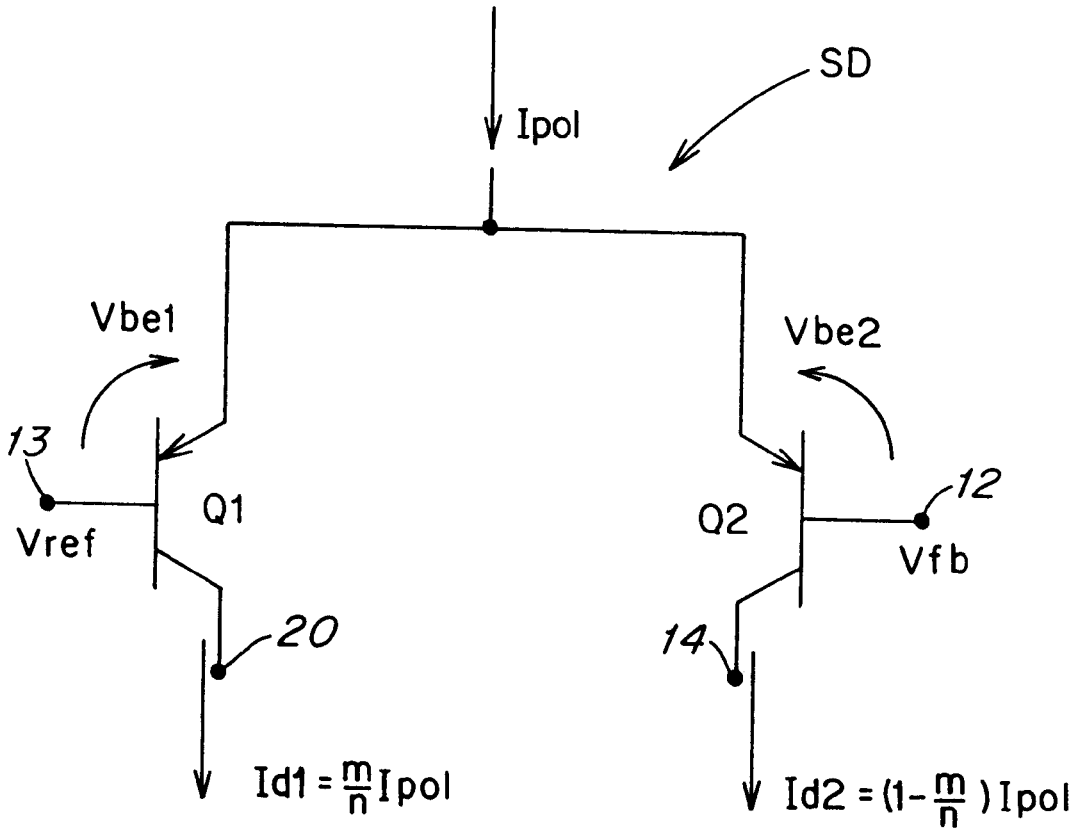
FIG. 5 shows a detail of the regulator in FIG. 4.

A threshold value Vth can be obtained for the output voltage Vout of the regulator 10 as the switch SW of the serial output element 18 is closed, that is upon operation of the second conduction path, in view of that the differential stage SD of the error amplifier EA comprises, for example, first and second bipolar transistors Q1, Q2, as shown in FIG. 5.

Specifically, these first and second bipolar transistors Q1, Q2 are PNP transistors connected between the supply voltage reference VS and the second output terminals 20 and 14, respectively. In addition, the first bipolar transistor Q1 has its base terminal connected to the second input terminal 13 of the differential stage SD and receives the reference voltage Vref, while the second bipolar transistor Q2 has its base terminal connected to the first input terminal 12 of the differential stage SD and receives a voltage Vfb being a proportion of the output voltage Vout from the voltage divider 11.

Thus, the following relationships are arrived at:

$$Vfb = Vref + Vbe1 - Vbe2 = Vref + Vt * \ln\left(\frac{m}{n} * \frac{Ipol}{I_S}\right) - Vt * \ln\left(\left(1 - \frac{m}{n}\right) * \frac{Ipol}{I_S}\right) \tag{5}$$

where is the voltage at the first input terminal 12 of the differential stage SD;

Vref is the voltage at the second input terminal 13 of the differential stage SD;

Vbe1 is the base-emitter voltage of the first bipolar transistor Q1;

Vbe2 is the base-emitter voltage of the second bipolar transistor Q2;

Vt is the thermal voltage of the bipolar transistors Q1 and Q2 (as defined by the ratio kT/q, k being Boltzmann's constant, T being the absolute temperature, and q being the electron charge);

Ipol is the bias current of the differential stage SD; and $I_s$ is a constant that describes the active forward transfer characteristics of the bipolar transistors Q1 and Q2.

From relationship (5) the following conclusive relationship is obtained:

$$Vfb = Vref + Vt * \ln\left(\frac{n}{n - m}\right) \tag{6}$$

From the last-mentioned mathematical relationship (6), a restriction is derived which should be imposed on the switching stage 19; in fact, it must be n−m>0, i.e., n>m.

Since the first reference current Ir1 of the differential stage SD attains a maximum value which is equal to the bias current Ipol of that stage SD, in order to provide for switching of the switching stage 19, the first regulation current Ir1, equal to m*Ipol, must be lower than the second regulation current Ir2, which is equal to n*Ipol in the regulated condition.

For proper operation of the regulator 10 according to the invention, the following restriction must be met:

$$\frac{n}{2} < m < n \tag{7}$$

From the relationship:

$$Vfb = Vth * \frac{R2}{R1 + R2} \tag{8}$$

the threshold value Vth of the output voltage Vout is then obtained, as follows:

$$Vth = \left(1 + \frac{R1}{R2}\right) * Vfb = \left(1 + \frac{R1}{R2}\right) * \left(Vref + Vt * \ln\left(\frac{n}{n - m}\right)\right) \tag{9}$$

Where the differential stage SD is implemented with MOS-type transistors, by similar steps to those just mentioned for the differential stage SD with bipolar transistors, the following relationship, similar to (9), is obtained:

$$Vth = \left(1 + \frac{R1}{R2}\right) * \left(Vref + \sqrt{\frac{2}{K}} * \frac{W}{L} * Ipol * \left(\sqrt{\frac{m}{n}} - \sqrt{1 - \frac{m}{n}}\right)\right) \quad (10)$$

where,

K is a constant that describes the electrical characteristics of the MOS transistors employed (as defined by the product $\mu_n$*Cox, $\mu_n$ being the average mobility of the carriers, and Cox the gate-oxide capacitance per area unit of the MOS transistors); and W/L is a dimensional ratio of the MOS transistors employed.

Furthermore, similar considerations would apply to a regulator 21 comprising a serial output element 18 of the N-channel type, as shown in the modified embodiment of FIG. 3*b*. Accordingly, this modified embodiment will not be described in detail.

Figure 6A:
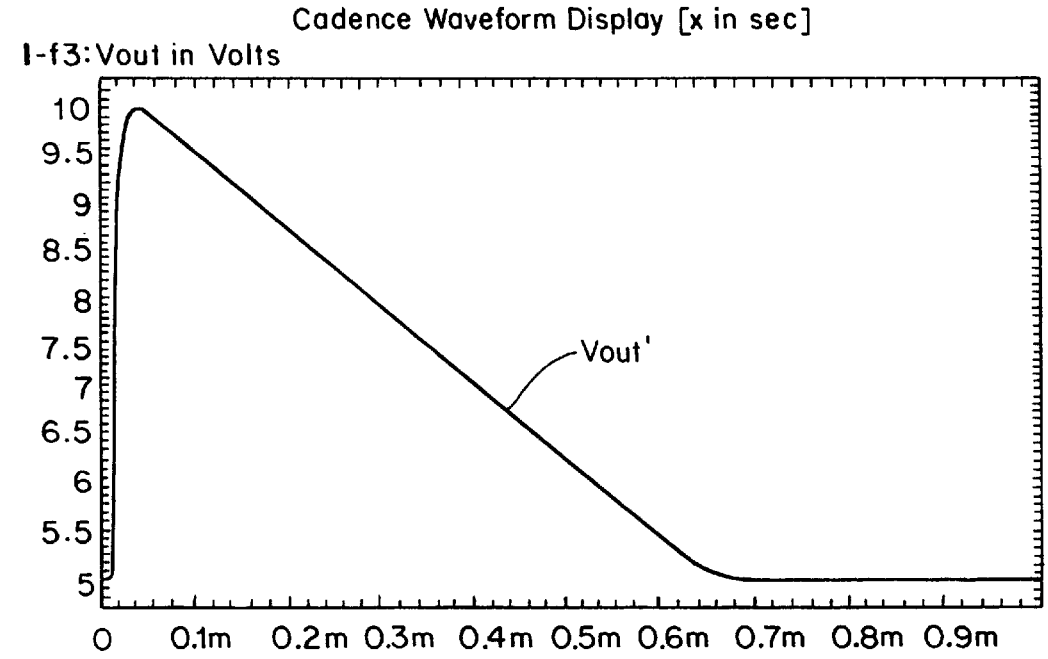
Fig. 6a (PRIOR ART)
FIGS. 6 and 7 show comparative results of simulations carried out on known regulators according to the present invention.
Figure 6B:
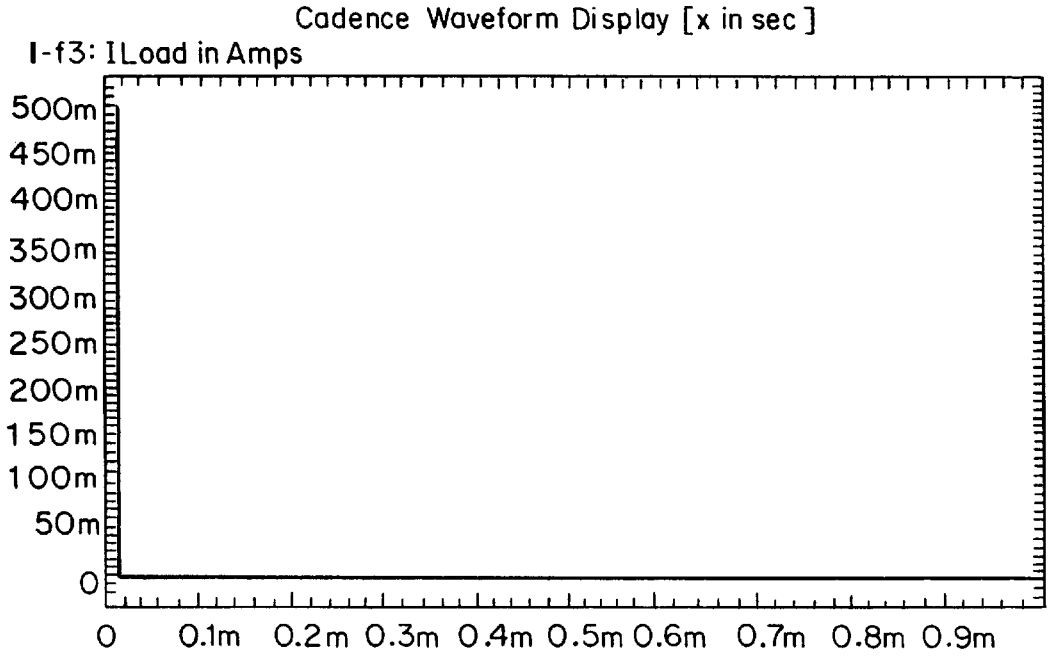
Fig 6b (PRIOR ART)
Figure 7A:
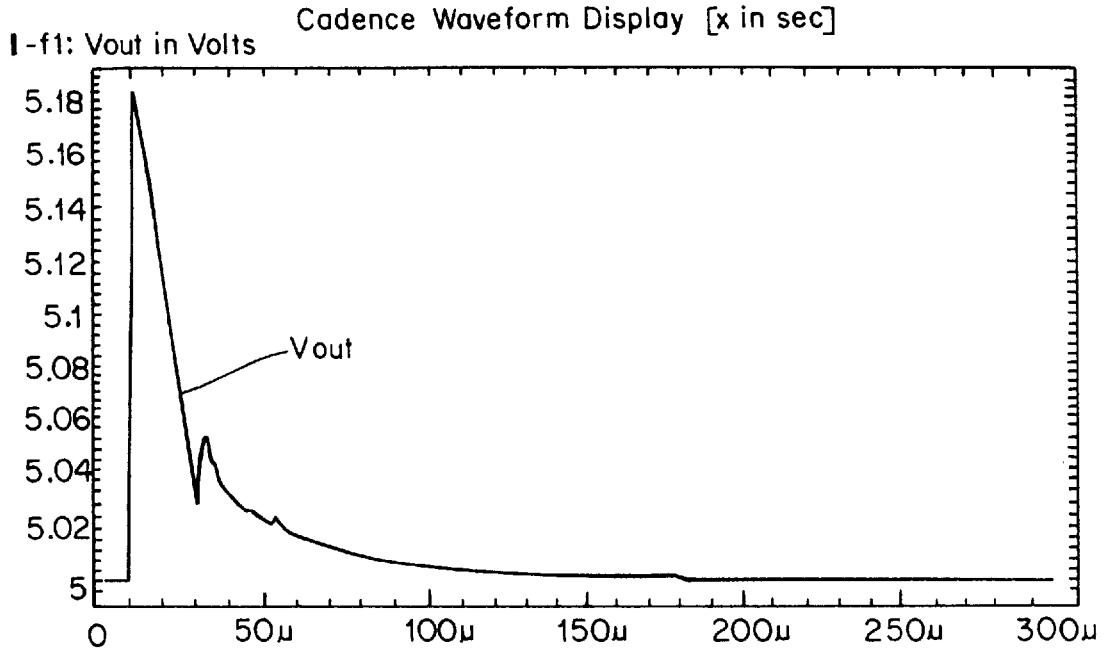
Figure 7B:
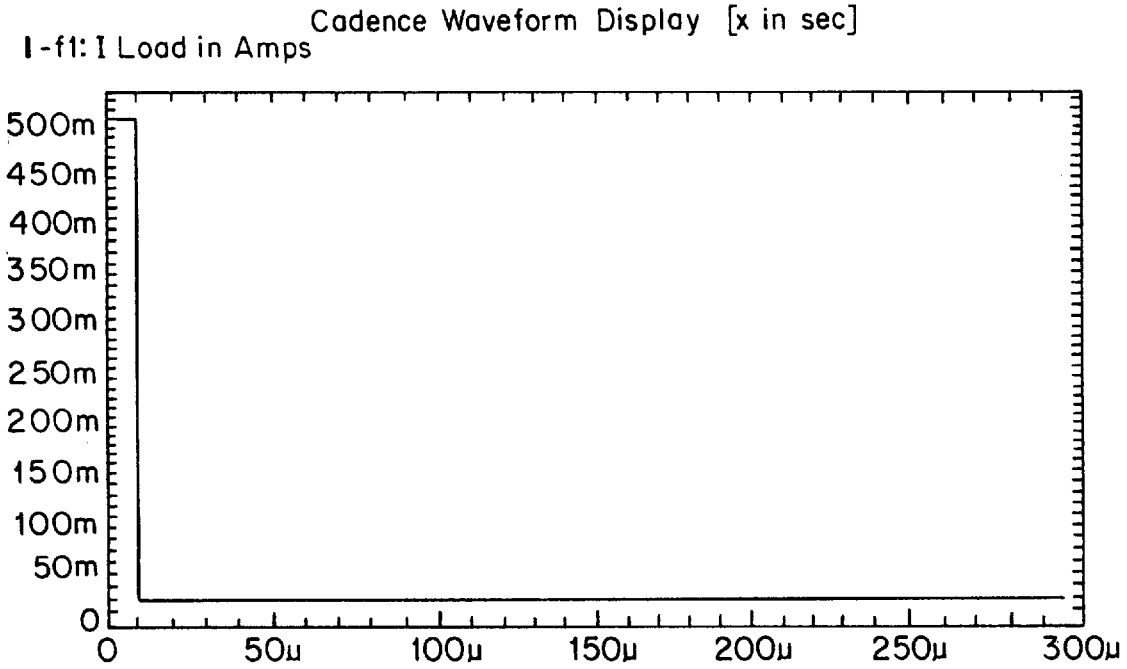

Shown in FIGS. 6 and 7 are the results of a simulation carried out on regulators of the low-drop type, comprising a serial output element 18 of the P-channel type and a resistive divider where R1=374 kOhm and R2=126 kOhm. The results for conventional design regulators are shown in FIG. 6; those for regulators according to this invention, in particular where n=2 and m=3/2, are shown in FIG. 7. A change in the output load was applied to each regulator, resulting in a change of 500 mA in the output current Io.

As shown in FIG. 6, the output voltage Vout' of the previously known regulator 1 attains a maximum value of 10V before falling back to the regulated condition.

The output voltage Vout of the regulator 10 according to the present invention, as shown in FIG. 7, on the contrary, has an overshoot of just 180 mV.

This simulated overshoot is larger than that of 113 mV to be obtained from relationship (9); the difference is due to the fact that relationship (9) does not account for the delay introduced by the closing of the switch SW.

These simulation results have been further confirmed experimentally by using a low-drop regulator which comprised a serial output element 18 of the P-channel type; this regulator, made with mixed BCD60II technology, had an overall internal consumption of just 10 $\mu$A.

The first conduction path of a voltage regulator according to the present invention is active in the regulated condition, that is, a closed loop condition. It allows for the regulation of the output voltage Vout to be affected for small signal changes, i.e., for infinitesimal shifts in the voltage Vout.

With large changes in the output voltage Vout, on the other hand, the first conduction path would be off, and the regulator would have to operate under an open loop condition. Thus,an unbalance is established within the regulator, specifically in the error amplifier EA.

Under this condition, the circuitry present in the first conduction path will tend all the same to cause the regulator to turn off the output element 18; the delay involved in this turn-off is, however, unacceptable for many applications.

Advantageously in this invention, the second conduction path of the regulator is able to operate under the unbalanced condition of the regulator, that is with large load changes. This second conduction path allows the serial output element 18 to be turned off rapidly, thus avoiding unnecessary overshooting of the output voltage Vout.

In conclusion, the regulator of this invention affords the following advantages: the switching stage 19 is off in the regulated condition, and accordingly, will alter neither the loop gain nor the frequency performance of the regulator; the overshoot of the output voltage Vout from the regulator can be limited (maybe down to a few hundreds of millivolts) by suitably selecting the design parameters n and m for the switching stage 19; the switching stage 19 contributes to consumption with an amount equal to (n/2)*Ipol, that is a fraction of the bias current of the differential stage SD, this amount being a trivial one compared to the overall consumption of the regulator; and the regulator of this invention has a fast response speed to changes in the load, and during regulator on/off transients.

Having thus described at least one illustrative embodiment of the invention, various alterations, modifications and improvements will readily occur to those skilled in the art. Such alterations, modifications and improvements are intended to be within the spirit and scope of the invention. Accordingly, the foregoing description is by way of example only and is not intended as limiting. The invention is limited only as defined in the following claims and the equivalents thereto.

What is claimed is:

1. A linear voltage regulator connected between first and second voltage references and having an output terminal for delivering a regulated output voltage, comprising:

at least one voltage divider connected between the output terminal and the second voltage reference;

a serial output element connected between the output terminal and the first voltage reference;

said at least one voltage divider connected to the serial output element by a first conduction path which includes at least one error amplifier, a first output of which is connected to at least one driver for turning off the serial output element; and at least a second conduction path coupled between the voltage divider and the serial output element for turning off the serial output element according to a value of the regulated output voltage, in advance of an action of the first conduction path.

2. The linear voltage regulator according to claim 1, wherein:

said second conduction path is disposed between a second output terminal of the error amplifier and the serial output element.

3. The linear voltage regulator according to claim 2, wherein:

said second conduction path includes at least one switch connected between said second output terminal of the error amplifier and said serial output element.

4. The linear voltage regulator according to claim 3, wherein said switch is connected between said first voltage reference and said serial output element.

5. The linear voltage regulator according to claim 3, wherein said at least one switch is connected between said output terminal of the linear voltage regulator and said serial output element.

6. The voltage regulator according to claim 3, wherein:

said second conduction path further includes a switching stage, being powered across the first and the second voltage references and connected between the second output terminal of said error amplifier and the at least one switch.

7. The voltage regulator according to claim 6, wherein said switching stage comprises:

first and second current generators, connected in series with each other between the first and second voltage references, and an internal circuit node between the first and second current generators which is connected to the at least one switch through a second switch; and said second current generator connected to the second output terminal of the error amplifier.

8. The linear voltage regulator according to claim 7, wherein said error amplifier includes:

a bias current generator;

wherein the error amplifier delivers a reference current on its second output terminal;

wherein the first current generator of the switching stage delivers a first regulation current that is a first multiple m of a bias current; and wherein the second current generator of the switching stage delivers a second regulation current being a second multiple n of the first reference current for the error amplifier.

9. The linear voltage regulator according to claim 8, wherein said first multiple m of the bias current is greater than one half said second multiple n of the first reference current and smaller than said second multiple n of the first reference current.

10. A method of turning off a serial output element as a regulated output voltage from a linear voltage regulator changes, said linear voltage regulator including a first conduction path connected between a divider of said regulated output voltage and the serial output element, the method comprising:

providing at least a second conduction path disposed between said voltage divider and said serial output element for turning off said serial output element on the occurrence of the change in the regulated output voltage in advance of an action of the first conduction path.

11. The method according to claim 10, wherein said second conduction path turns off said serial output element as a node voltage at an internal circuit node in said second conduction path falls sharply.

12. The method according to claim 10, wherein said second conduction path includes at least one switch controlled by said voltage at the internal circuit node to turn off the serial output element.

13. The method according to claim 12, wherein said at least one switch is controlled by a switching stage, the switching stage comprising first and second current generators connected to each other at the internal circuit node, the first current generator of the switching stage delivering a first regulation current being a first multiple m of a bias current of an error amplifier included in said first conduction path, and the second current generator delivering a second regulation current being a second multiple n of a first reference current of the error amplifier, and wherein said node voltage at the internal circuit node falls sharply upon the second regulation current overtaking the first regulation current.

14. The method of according to claim 13, wherein said error amplifier comprises first and second bipolar transistors, and said second conduction path turns off the serial output element upon the regulated output voltage from the linear voltage regulator attaining a threshold value Vth given by, $$Vth = \left(1 + \frac{R1}{R2}\right) * Vfb = \left(1 + \frac{R1}{R2}\right) * \left(Vref + Vt * \ln\left(\frac{n}{n-m}\right)\right)$$

wherein:

R1, R2 are characteristic values of the voltage divider;

Vfb, Vref are reference voltages of the error amplifier;

Vbe1, Vbe2 are base-emitter voltages of the first and second bipolar transistors, respectively; and Vt is a thermal voltage of each of the first and second bipolar transistors.

15. The method according to claim 13, wherein said error amplifier comprises first and second MOS transistors, and said second conduction path turns off the serial output element upon the regulated output voltage from the linear voltage regulator attaining a threshold value given by, $$Vth = \left(1 + \frac{R1}{R2}\right) * \left(Vref + \sqrt{\frac{2}{K}} * \frac{W}{L} * Ipol * \left(\sqrt{\frac{m}{n}} - \sqrt{1 - \frac{m}{n}}\right)\right)$$

wherein:

R1, R2 are characteristic values of the voltage divider;

Vref is a reference voltage of the error amplifier;

K is a constant that describes an electric characteristic of the first and second MOS transistors employed; and W/L is a dimensional ratio of each of the first and second MOS transistors.

16. A linear voltage regulator, comprising:

first means for providing a regulated output voltage;

second means for comparing the regulated output voltage to a reference voltage;

third means, coupled to the first and second means, for controlling a value of the regulated output voltage in response to a first change in the regulated output voltage; and fourth means, coupled to the first and second means, for controlling the value of the regulated output voltage in response to a second change, different from the first change, in the regulated output voltage.

17. The linear voltage regulator as recited in claim 16, wherein:

the first change is smaller than the second change.

18. The linear voltage regulator as recited in claim 16, wherein the second means comprise:

an error amplifier having a first input coupled to the reference voltage, a second input coupled to the regulated output voltage, and first and second outputs; and wherein the fourth means comprise:

a switching stage having an input coupled to the second output of the error amplifier and an output coupled to the first means.

19. The linear voltage regulator as recited in claim 18, wherein the fourth means further comprise:

a switch coupled between the output of the switching stage and the first means.

20. The linear voltage regulator as recited in claim 18, wherein the error amplifier comprises:

a bias current generator to generate a bias current;

a differential stage coupled to the bias current generator including a first input coupled to the reference voltage, a second input coupled to the regulated output voltage, a first output of the differential stage coupled to the first output of the error amplifier to provide a first output current and a second output of the differential stage coupled to the second output of the error amplifier to provide a second output current;

wherein, when the reference voltage at the first input is substantially equal to the regulated output voltage coupled to the second input, the second output current is about one-half of the bias current.

21. The linear voltage regulator as recited in claim 20, wherein the switching stage further comprises:

a first reference current generator to generate a first reference current which is a first multiple m of the bias current; and a second reference current generator coupled to the first reference current generator at a switching stage node, the second reference current generator to generate a second reference current which is a second multiple n of the second output current; and wherein the first multiple m is not equal to the second multiple n.

22. The linear voltage regulator as recited in claim 21, wherein:

$$\frac{n}{2} < m < n.$$

23. A method of regulating an output voltage comprising:

(a) providing a feedback voltage as a function of an output voltage level;

(b) providing a reference voltage;

(c) generating a bias current;

(d) comparing the reference voltage to the feedback voltage;

(e) generating a first reference current which is a function of the comparison of the reference voltage to the feedback voltage performed in step (d) and the bias current;

(f) generating a first regulated current which is a first multiple m of the bias current;

(g) generating a second regulated current which is a second multiple n of the first reference current; and (h) turning off a serial output element when the second regulated current is not greater than the first regulated current.

24. The method as recited in claim 23, further comprising:

selecting the first multiple m and the second multiple n such that $$\frac{n}{2} < m < n.$$

25. The method as recited in claim 23, wherein step (a) comprises:

providing the output voltage to a voltage divider.

* * * * *

UNITED STATES PATENT AND TRADEMARK OFFICE

CERTIFICATE OF CORRECTION

PATENT NO. : 5,945,819

DATED : August 31, 1999

INVENTOR(S) : Riccardo Ursino and Roberto Gariboldi

It is certified that error appears in the above-identified patent and that said Letters Patent is hereby corrected as shown below:

Col. 3, line 29 should read:
FIG. 4 shows in greater detail the structure of the regulator in Col. 3, line 46 should read:
elements, R1, R2, and a common node between them is Col. 4, line 44 should read:
connected to a switch driver SW2

Signed and Sealed this
Fourth Day of January, 2000

*Attest:*

*Attesting Officer*

*Acting Commissioner of Patents and Trademarks*